US009078516B2

(12) United States Patent
Vogel

(10) Patent No.: US 9,078,516 B2
(45) Date of Patent: Jul. 14, 2015

(54) WINE RACK STORAGE SYSTEM

(71) Applicant: Glenn Vogel, Evergreen, CO (US)

(72) Inventor: Glenn Vogel, Evergreen, CO (US)

( * ) Notice: Subject to any disclaimer, the term of this patent is extended or adjusted under 35 U.S.C. 154(b) by 0 days.

(21) Appl. No.: 14/062,694

(22) Filed: Oct. 24, 2013

(65) Prior Publication Data

US 2014/0110364 A1 Apr. 24, 2014

Related U.S. Application Data

(60) Provisional application No. 61/717,685, filed on Oct. 24, 2012.

(51) Int. Cl.
*A47B 73/00* (2006.01)
*A47B 43/00* (2006.01)
(Continued)

(52) U.S. Cl.
CPC ..... *A47B 73/00* (2013.01); *A47B 47/0058* (2013.01); *A47B 47/0083* (2013.01); *A47B 47/028* (2013.01); *A47B 47/045* (2013.01); *A47B 57/04* (2013.01); *A47B 81/007* (2013.01);
(Continued)

(58) Field of Classification Search
CPC .. A47B 47/0058; A47B 96/02; A47B 96/028; A47B 96/14; A47B 96/1441; A47B 73/00; A47B 57/04; A47B 96/06; A47B 47/0083; A47B 47/024; A47B 47/028; A47B 47/045; A47B 57/06; A47B 57/30; A47B 47/021; A47B 55/00; A47B 81/00; A47B 81/007; A47B 46/00; A47F 7/28; A47F 7/281; A47F 5/12; A47F 5/0037; A47F 5/16; A47F 5/0018; A47F 2005/165; A47F 5/0031; A47F 5/0043; A47F 5/0081; A47F 5/01; A47F 5/103; A47F 5/10; A47F 5/101; A47F 5/13; A47F 7/0021; A47F 7/0035; A47F 11/10; A47F 3/001; F21S 2/00; F21S 4/00; F21S 4/001; F21S 4/003; F21S 4/005; F21S 4/006; F21S 4/007; F21S 4/008; F21S 10/00; F21S 10/063; F21V 33/004; F21V 33/0012; F21V 33/02; F21V 19/02; F21Y 2103/00
USPC ..... 211/74, 75, 34–38, 49.1, 150, 164, 103, 211/187, 189, 193, 105.1, 105.3, 123, 204, 211/206, 134; 362/234, 253, 220, 127, 134, 362/217.02
See application file for complete search history.

(56) References Cited

U.S. PATENT DOCUMENTS

D23,450 S * 7/1894 Heffner ..... D6/465
1,632,820 A * 6/1927 Cofar ..... 211/34
(Continued)

OTHER PUBLICATIONS

Wine Cellar Innovations, "Black Lattice Wine Racks", as downloaded on Feb. 16, 2011 from http://www.winecellarinnovations.com/wine-racks/metal-wine/racks/, 1 page.
(Continued)

*Primary Examiner* — Jennifer E Novosad
(74) *Attorney, Agent, or Firm* — Holland & Hart LLP

(57) ABSTRACT

Systems, methods, and apparatuses are described for secure, flexible, aesthetically pleasing wine bottle storage. The various embodiments include modular wine bottle storage systems that allow wine bottles to be stored at various angles, which, in turn, may allow for both wine bottles display and safekeeping. Additionally, the described tools and techniques may be employed to create scalable and customizable wine bottle storage, such that different embodiments may allow numerous bottle storage configurations.

13 Claims, 8 Drawing Sheets

(51) Int. Cl.

| | |
|---|---|
| ***A47B 47/00*** | (2006.01) |
| ***A47B 57/00*** | (2006.01) |
| ***A47B 23/06*** | (2006.01) |
| ***A47B 47/02*** | (2006.01) |
| ***A47B 96/14*** | (2006.01) |
| ***A47B 81/00*** | (2006.01) |
| ***A47B 47/04*** | (2006.01) |
| ***A47F 11/10*** | (2006.01) |
| ***A47F 5/16*** | (2006.01) |
| ***A47F 3/00*** | (2006.01) |
| ***A47F 7/28*** | (2006.01) |
| ***F21V 19/02*** | (2006.01) |
| ***F21V 33/00*** | (2006.01) |
| ***F21S 4/00*** | (2006.01) |
| ***A47B 57/04*** | (2006.01) |

(52) U.S. Cl.

CPC ..... *A47B 96/1441* (2013.01); *A47F 3/001* (2013.01); *A47F 5/16* (2013.01); *A47F 7/28* (2013.01); *A47F 11/10* (2013.01); *F21S 4/003* (2013.01); *F21S 4/007* (2013.01); *F21V 19/02* (2013.01); *F21V 33/0012* (2013.01)

(56) References Cited

U.S. PATENT DOCUMENTS

| | | | | |
|---|---|---|---|---|
| 2,012,983 | A | 9/1935 | Bales | |
| 2,170,641 | A | 8/1939 | Lancelot | |
| 2,294,504 | A * | 9/1942 | Knape | 211/38 |
| 3,606,023 | A | 9/1971 | Edmunds | |
| 3,746,178 | A | 7/1973 | Wagschal | |
| 3,896,936 | A | 7/1975 | Notarius | |
| 4,023,681 | A | 5/1977 | Plant | |
| 4,282,977 | A * | 8/1981 | Di Lorenzo | 211/74 |
| 4,438,604 | A * | 3/1984 | McGourty et al. | 52/28 |
| D278,110 | S | 3/1985 | Boland, II | |
| 4,579,233 | A | 4/1986 | Hepp | |
| 4,739,454 | A * | 4/1988 | Federgreen | 362/133 |
| 4,942,967 | A | 7/1990 | Schneider | |
| 4,998,631 | A | 3/1991 | Fridjhon | |
| 5,034,861 | A * | 7/1991 | Sklenak et al. | 362/92 |
| 5,169,009 | A * | 12/1992 | Bomze | 211/74 |
| 5,197,612 | A | 3/1993 | Thomson | |
| 5,215,199 | A | 6/1993 | Bejarano | |
| 5,453,917 | A * | 9/1995 | Ogawa | 362/222 |
| 5,457,614 | A * | 10/1995 | Duty | 362/220 |
| 5,826,731 | A | 10/1998 | Dardashti | |
| 5,904,257 | A | 5/1999 | Marmet et al. | |
| 6,231,205 | B1 * | 5/2001 | Slesinger et al. | 362/133 |
| 6,257,420 | B1 * | 7/2001 | Dardashti et al. | 211/40 |
| 6,257,427 | B1 * | 7/2001 | Schneid | 211/189 |
| 6,364,273 | B1 * | 4/2002 | Otema | 248/444.1 |
| 6,582,096 | B1 * | 6/2003 | Searer | 362/253 |
| 6,672,552 | B1 * | 1/2004 | Jao | 248/251 |
| 6,729,481 | B1 * | 5/2004 | O'Brien | 211/74 |
| 6,763,956 | B2 | 7/2004 | Woods | |
| 6,799,863 | B2 * | 10/2004 | Offiler et al. | 362/220 |
| 6,866,396 | B2 * | 3/2005 | Ward | 362/220 |
| D512,283 | S | 12/2005 | Pratt | |
| 6,981,597 | B2 * | 1/2006 | Cash | 211/74 |
| 7,063,219 | B2 | 6/2006 | Fann et al. | |
| 7,168,580 | B2 | 1/2007 | Larimer et al. | |
| 7,249,680 | B2 * | 7/2007 | Wang | 211/37 |
| 7,726,839 | B2 | 6/2010 | Chien | |
| 7,850,017 | B2 | 12/2010 | McCain | |
| 7,878,340 | B1 | 2/2011 | Olsen | |
| 7,882,967 | B2 | 2/2011 | Hynes | |
| 8,113,678 | B2 * | 2/2012 | Babcock et al. | 362/125 |
| 8,979,296 | B2 * | 3/2015 | Wiemer et al. | 362/125 |
| 2004/0245200 | A1 * | 12/2004 | Jersey et al. | 211/189 |
| 2004/0257802 | A1 * | 12/2004 | Helenowski | 362/217 |
| 2005/0162850 | A1 * | 7/2005 | Luk et al. | 362/227 |
| 2005/0237732 | A1 * | 10/2005 | Lagman et al. | 362/132 |
| 2006/0126325 | A1 * | 6/2006 | Lefebvre et al. | 362/217 |
| 2008/0277361 | A1 * | 11/2008 | Primiano | 211/49.1 |
| 2009/0316385 | A1 | 12/2009 | Weber et al. | |
| 2010/0006523 | A1 * | 1/2010 | Hogeback | 211/74 |
| 2010/0053965 | A1 | 3/2010 | Chang et al. | |
| 2012/0230018 | A1 * | 9/2012 | Wiemer et al. | 362/133 |
| 2012/0325759 | A1 * | 12/2012 | Hogeback | 211/26 |
| 2013/0119004 | A1 * | 5/2013 | Lange | 211/74 |
| 2013/0182428 | A1 * | 7/2013 | Seehof | 362/220 |
| 2013/0188356 | A1 * | 7/2013 | Breslow et al. | 362/247 |
| 2013/0193098 | A1 * | 8/2013 | Fanourgiakis et al. | 211/134 |
| 2013/0233814 | A1 * | 9/2013 | Gupta | 211/74 |
| 2013/0299439 | A1 * | 11/2013 | Sid et al. | 211/134 |
| 2014/0055987 | A1 * | 2/2014 | Lindblom et al. | 362/125 |
| 2014/0232968 | A1 * | 8/2014 | Su | 349/58 |
| 2014/0247619 | A1 * | 9/2014 | Bennett et al. | 362/558 |
| 2014/0254136 | A1 * | 9/2014 | Oraw et al. | 362/92 |

OTHER PUBLICATIONS

Carper, Jim, Modular Wine Rack with LED Lighting (http://www.fespecifier.com/?=385), as downloaded on Feb. 16, 2011 from http://www.ffespecifier.com/?p=385, 1 page.

The Wagner Companies, "Lumenrail® Lighted Handrail and Railing System", as downloaded on Apr. 1, 2011 from http://www.lumenrail.com/pages/Lumenrail.htm, 4 pages.

The Wagner Companies, "LED Light Stick", as downloaded on Apr. 1, 2011 from http://www.wagnercompanies.com/site/Viewer.aspx?iid=6330&mna/, 2 pages.

"Stainless Steel Tube License Plate Light 6 LED—iowa80.com", as downloaded on Apr. 1, 2011 from http://www.iowa80.com/DirectionsWEB/webcart_productDisplay.php, 1 page.

* cited by examiner

WINE RACK STORAGE SYSTEM

CROSS REFERENCES

The present Application for Patent claims priority benefit to U.S. Provisional Patent Application No. 61/717,685, entitled "Wine Rack Storage System," by Glenn Vogel, filed Oct. 24, 2012, and expressly incorporated by reference herein.

BACKGROUND

Wine bottle storage involves a variety of challenges. Wine bottles traditionally and typically may be sealed with a cork. So, wine bottles preferably may be stored such that the contents of the bottle—the wine—maintains contact with the cork, which may prevent the cork from drying, and thus prevent the wine from spoiling.

Additionally or alternatively, it may be desirable to store wine bottles such that their labels may be displayed. But, when displaying a wine bottle in a position that allows its label to be read, it may be difficult to maintain the bottle in a position such that the cork remains in contact with the bottle contents. Moreover, wine bottles are often stored in dark locations, such that reading a bottle label may be difficult, regardless of the bottle angle.

Furthermore, wine bottles are fragile, and so displaying a bottle may be at odds with safekeeping of the bottle. For example, displaying a bottle such that its label is easily viewed may leave the bottle vulnerable to be shaken or knocked loose from its display.

In view of the foregoing, a wine bottle storage system that offers safe storage and attractive display options may be desirable. It may also be desirable for a wine bottle storage system to be versatile, such that it is capable of various storage and display configurations. Additionally or alternatively, it may be desirable for a wine bottle storage system to be easily assembled and disassembled.

SUMMARY

The described features generally relate to one or more improved systems, methods, and/or apparatuses for wine bottle storage. The systems, methods, and/or apparatuses may include tools and techniques that provide for secure, flexible wine bottle storage, while being configurable for an aesthetically pleasing display.

In a first set of illustrative embodiments, a wine bottle storage system includes a first bottle shelf and a second bottle shelf, each of which include a front tube pair, a back tube pair, a first end, and a second end. The wine bottle storage system may also include a first upright and a second upright. The first and second uprights may be disposed parallel to one another and in a plane normal to the first and second bottle shelves. The first end of the first bottle shelf and the first end of the second bottle shelf may be connected to the first upright, and the second end of the first bottle shelf and the second end of the second bottle shelf may be connected to the second upright.

The wine bottle storage system of the first set of embodiments may include additional shelves. In some cases, the shelves include additional tube pairs. In still other examples, the wine storage system includes pivotable shelves or integrated light tubes, or both.

In second set of illustrative embodiments, a wine bottle storage system includes a first bottle storage means and a second bottle storage means, each having a punt holder, a neck holder, a first bracket, and a second bracket. The wine bottle storage system may also include first and second upright means. The first and second upright means may be disposed parallel to one another and in a plane normal to the first and second bottle storage means, and the first brackets of each of the first and second bottle storage means may be removably attached to the first upright means, and the second brackets of each of the first and second bottle storage means may be removably attached to the second upright means. The first and second bottle storage means may be disposed parallel to one another.

In the second set of illustrative embodiments, the first or second bottle storage means may include a punt holder and a neck holder offset by between five and thirty degrees. In some cases, the first or second storage means include pivotable brackets or integrated light tubes, or both.

Additionally or alternatively, various embodiments described herein may include one or more brackets configured to support tubing for a wine bottle storage shelf. The brackets may include a body section which is capable of attaching to an upright and/or for facilitating wiring to a light tube. In some examples, the brackets include a pivotable body section.

Further scope of the applicability of the described methods and apparatuses will become apparent from the following detailed description, claims, and drawings. The detailed description and specific examples are given by way of illustration only, since various changes and modifications within the spirit and scope of the description will become apparent to those skilled in the art.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Detailed embodiments are directed to systems, methods, and apparatuses for secure, flexible, aesthetically pleasing wine bottle storage. The various embodiments include modular wine bottle storage systems that may allow wine bottles to be stored at various angles and may provide for display and safekeeping. Additionally, the described tools and techniques may allow for scalable and customizable wine bottle storage, such that different embodiments may allow numerous bottle storage configurations. And the described systems may provide for easy assembly, disassemble, and shipping.

The following description provides examples, and is not limiting of the scope, applicability, or configuration set forth in the claims. Changes may be made in the function and arrangement of elements discussed without departing from the spirit and scope of the disclosure. Various embodiments may omit, substitute, or add various procedures or components as appropriate. For instance, the features described with respect to certain embodiments may be combined in other embodiments. Also, methods described may be performed in an order different from that described, and various steps may be added, omitted, or combined.

Figure 1:
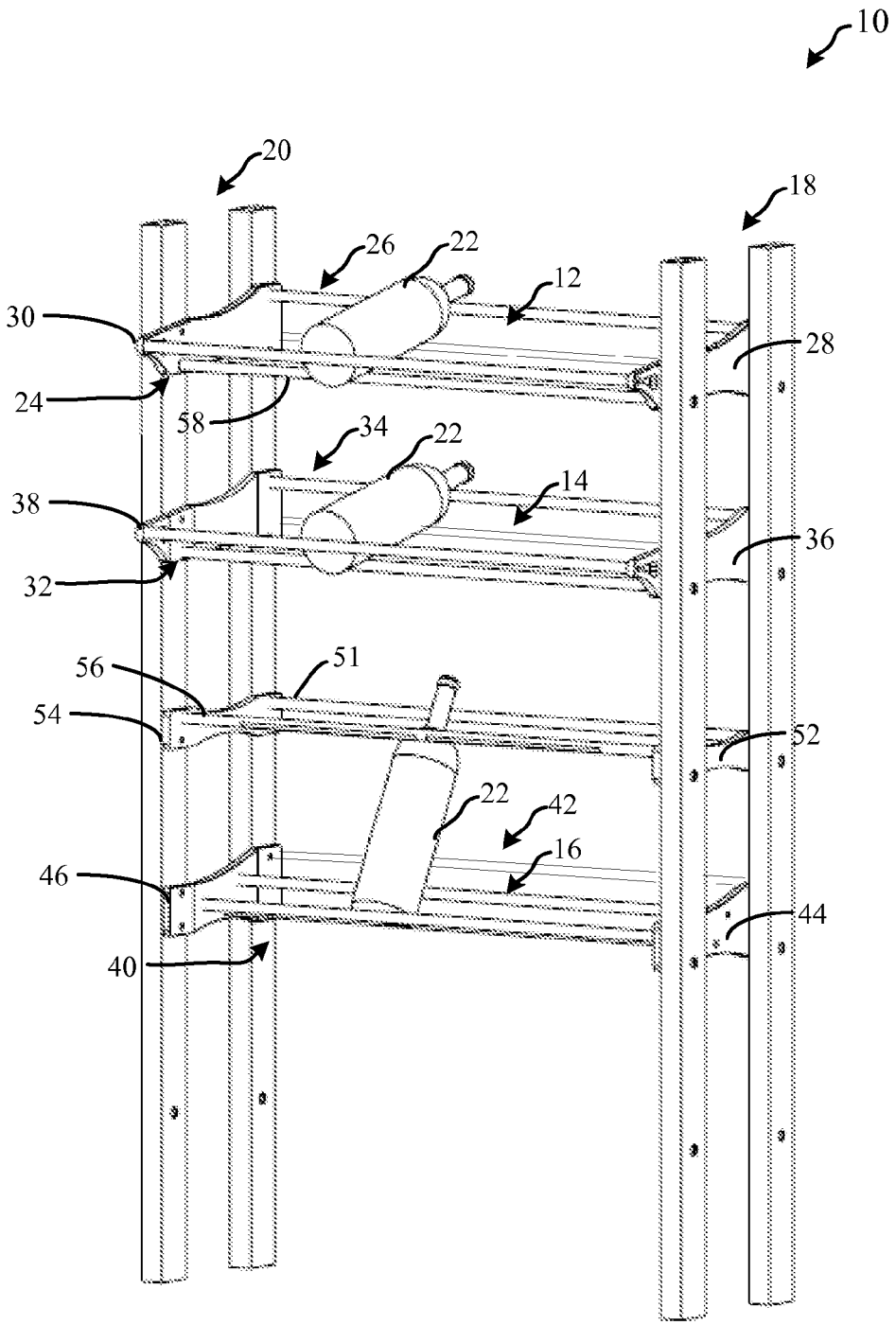
FIG. 1 shows a perspective view of a wine bottle storage system according to various embodiments.
Figure 2:
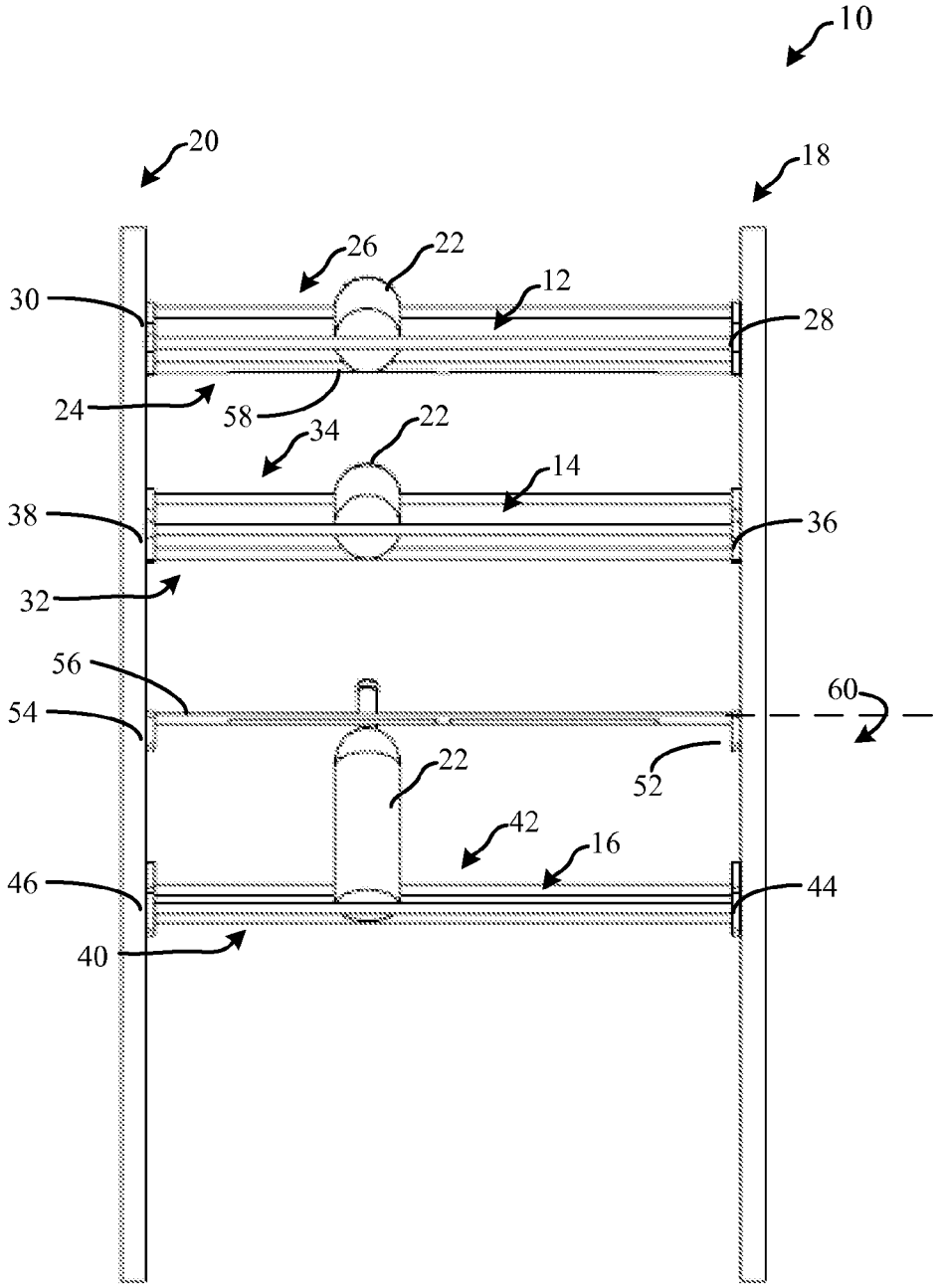
FIG. 2 shows a front view of wine bottle storage system according to various embodiments.
Figure 3:
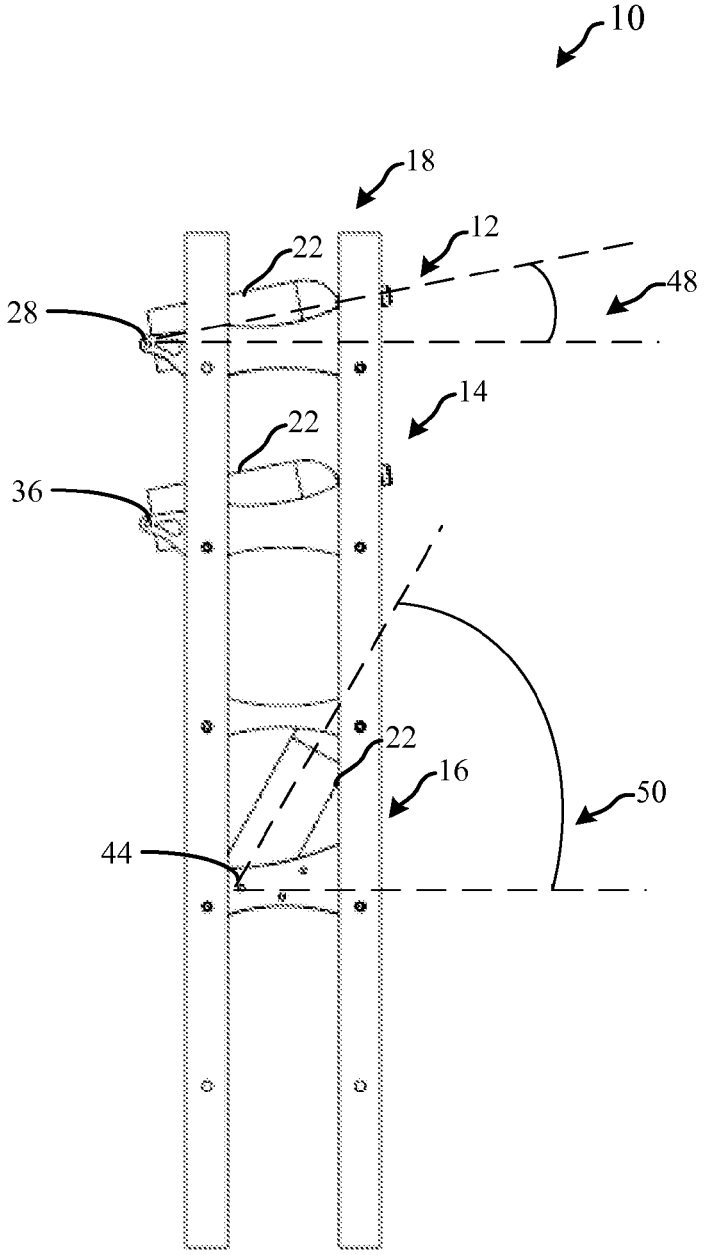
FIG. 3 shows a side view of wine bottle storage system according to various embodiments.

Referring first to FIG. 1, FIG. 2, and FIG. 3, perspective, front, and side views, respectively, of a wine bottle storage system 10 are shown. The wine bottle storage system 10 may include a first bottle shelf 12, a second bottle shelf 14, and a third bottle shelf 18. The bottle shelves 12, 14, and 16 may be connected to, and supported by first and second uprights 18 and 20. In some cases, the uprights 18 and 20 are each twin uprights—e.g., each upright 18 and 20 may have two parallel members.

The bottle shelves 12, 14, and 16 may each include a number of tubes that offer both structural support and serve to hold wine bottles 22. For example, the first bottle shelf may include a front tube pair 24 and a back tube pair 26. In some embodiments, the tube pairs 24 and 26 are configured parallel to one another and in a manner that allows a wine bottle 22 to nest in the bottle storage shelf 12. In some cases, the front tube pair 24 is referred to as a punt holder and the back tube pair 26 is referred to as a neck holder. For example, the punt (or base) of a wine bottle 22 may be cradled by the front tube pair 24 such that the bottom of the bottle abuts one tube of the front tube pair 12 and the side of the bottle abuts the other tube of the front tube pair 24. The neck of a wine bottle 22 may be supported by one tube of the back tube pair 26. In some embodiments, the second tube of the back tube pair 26 does not contact a wine bottle 22, and instead acts as structural support member for the first bottle storage shelf 12. Thus, while described as a back tube pair 26, those skilled in the art will recognize that the first bottle shelf 12 may be provided with a single back tube.

The first bottle shelf 12 may include ends 26 and 28. Each of the ends 26 and 28 may be brackets that are removably attachable to the uprights 18 and 20, respectively. The ends 26 and 28 may be attached or connected to the uprights 18 and 20 using bolt, nuts, washers, screws, brads, or the like. The tube pairs 24 and 26 likewise may be removably attached or connected to the ends 26 and 28 using bolts, nuts, washers, screws, brads, or the like. In some embodiments, a single fastener, such as a bolt, may be used to attach a tube to an end 28, 30, and to an upright 18, 20.

The shelves 14 and 16 may be similarly configured. For example, the second bottle shelf 14 may include a front tube pair 32, a back tube pair 34, a first end 36, and a second end 38. Each of these various components may be substantially the same as the components of the first bottle shelf 12, and they may be removably attached or connected to other components utilizing similar hardware as described above. Likewise, the third bottle shelf 16 may include a front tube pair 40, a back tube pair 42, a first end 44, and a second end 46. Each of these various components may be substantially the same as the components of the first bottle shelf 12, and they may be removably attached or connected to other components utilizing similar hardware as described above.

Additionally or alternatively, the bottle shelves 12, 14, and 16 may include tube pairs 24, 26, 32, 34, 40, and 42 configured to hold a wine bottle 22 at different angles. For example, as best seen in FIG. 3, the first bottle shelf 12 may be configured to hold a wine bottle 22 at an angle 48. This angle 48 may be created by a planar offset between the front tube pair 24 and the back tube pair 26. Those skilled in the art will recognize that the angle 48 may be changed by adjusting the spacing between the tubes of the front tube pair 24 with respect to each other.

The angle 48 of the bottle shelf 12 may allow a wine bottle's 22 label to be displayed, while holding the bottle such that the contents maintain contact with the bottle's cork. That is, the angle 48 may achieve two goals: effectively displaying the wine bottle 22 while holding the bottle such the cork is not in danger of drying. By way of example, various shapes of wine bottles 22 necessitate different angles 48 because the taper of the wine bottle's 22 neck. Certain bottle shapes can be held at angles between five and fifteen degrees to maintain a "wet" cork; while other bottles shapes can be held at angles between five and thirty degrees to maintain a wet cork. Thus, the angle 48 may be between five and thirty degrees. Alternatively, the angle 48 may be between to five and fifteen degrees. In some examples, the angle 48 is eleven degrees. The bottle shelf 12 with the angle 48 may be employed to hold a wine bottle 22 with a label face up or face down, to facilitate reading the label from both above or below the bottle shelf 12.

The bottle shelves 12, 14, and 16 may be configured with more or fewer number of tubes than described. Additionally or alternatively, the bottle shelves 12, 14, and 16 may be configured with tube pairs different from one another. For example, the first bottle shelf 12 may be configured with tube pairs 24 and 26 having different spacing or creating different planar angles, or both, from the third shelf 16. In some embodiments, the bottle shelf 12, is configured such that the front tube pair 24 includes two tubes disposed parallel to each other and separated by a distance. The back tube pair 26 may likewise include two tubes disposed parallel to each other and separated by a distance. The front tube pair 24 may be disposed parallel to the back tube pair 26; and the front tube pair 24 and the back tube pair 26 may be separated by a distance greater than the distance(s) between the individual tubes of either tube pair 24, 26. In other words, a punt holder and a neck holder may be separated by a distance nearly equal to the length (or height) of a wine bottle 22, but the distance between the punt holder and neck holder is such as to allow a wine bottle 22 to nest in the shelf 12. The second and third shelves 14 and 16 may be similarly or differently configured.

In some embodiments, one or more of the shelves 12, 14, and 16 is configured to hold a wine bottle 22 at a near vertical angle. As best seen in FIG. 3, the third bottle shelf 16 may be configured to hold a wine bottle 22 at an angle 50. The angle 50 may be created by a planar offset between the front tube pair 40 of the bottle shelf 16 and a neck rest 52 (FIG. 1). The neck rest 51 may be a tube attached or connected to brackets 52, 54 at either end of the neck rest 51. The neck rest 52 may be attached or connected with hardware as described above.

In some embodiments, the neck rest 51 is disposed at a height above a shelf (e.g., the third bottle shelf 16), which height may be referred to as a "bottle height." A bottle height is a height suitable to hold a wine bottle 22. This height may vary according to the bottle type intended to be supported and/or displayed. Those skilled in the art will recognize that the angle 50 may be changed by adjusting the spacing between the front tube pair 40 and the neck rest 51. Additionally or alternatively, the angle 50 may be changed by adjusting the location of the front tube pair 40 with respect to the back tube pair 42. The angle 50 may be any angle that facilitates display of a wine bottle's 22 label. For example, the angle 50 may be between forty and eighty degrees. In some embodiments, the angle 50 is seventy-seven degrees.

In some embodiments, the system 10 may have a bottle shelf 16 configured to hold a wine bottle 22 with the neck down. Those skilled in the art will recognize that the bottle shelf 16 and the neck rest 51 may be configured to accommodate a wine bottle 22 in an inverted position.

The wine bottle storage system 10 may also include one or more light tubes 56, 58. For example, a light tube 58 may be integrated into a front tube pair 24, such that a front tube pair 24, e.g., a punt holder, may include the light tube 58. In some cases, a light tube 56 may be attached or connected to brackets 52, 54 shared with a neck rest 51. The light tubes 56, 58 may be configured with light emitting diode (LED) light strings mounted within the tubes. In some embodiments, the light tubes 56, 58 are machined such that an LED string can be nested within the light tube 56, 58. In this way, light from the LED string projects from the light tube 56, 58, but the LED string is protected by the light tube 56, 58 such that a falling bottle, for example, cannot contact or damage the LED string. In other words, the light tubes 56, 58 may be configured with integrated LEDs protected from outside objects.

The light tubes 56, 58 are configured to shine light on bottle shelves 14, 16 below each respective light tube 56, 58. Thus, in a dark wine cellar, for example, the labels of wine bottles 22 on shelves 14, 16 may be illuminated. In some cases, the light tubes 56, 58 are rotatable about their longitudinal axes. For example, as best seen in FIG. 2, the light tube 56 is rotatable 60 about its longitudinal axis. In some embodiments, the light tube 56 may be rotated to accommodate various configurations of the bottle shelf 16. So if, for instance, the angle 50 of a wine bottle 22 on the bottle shelf 16 changes, the light tube 56 may be correspondingly rotated to illuminate the label of the bottle. The light tube 58 may be similarly configured to accommodate various configurations of a bottle shelf 14 below. Rotating the light tubes 56, 58 may be referred to as indexing. The light tubes 56, 58 may thus be indexed and locked, or otherwise secured into place using hardware known in the art.

In some embodiments, the light tubes 56, 58 create a hidden lighting effect because the LEDs are not visible, but their light output is. The LEDs may be part of a high-performance, low-voltage lighting system with a low heat signature. Because the system may impart little heat, it may be suitable for climate controlled environments, such as a wine cellar. In some embodiments, conductors for the lighting system are routed within one or more of the uprights 18, 20 to and within the lighting tubes 56, 58. The LEDs may be dimmable, and they may include one or a number of colors.

Figure 4:
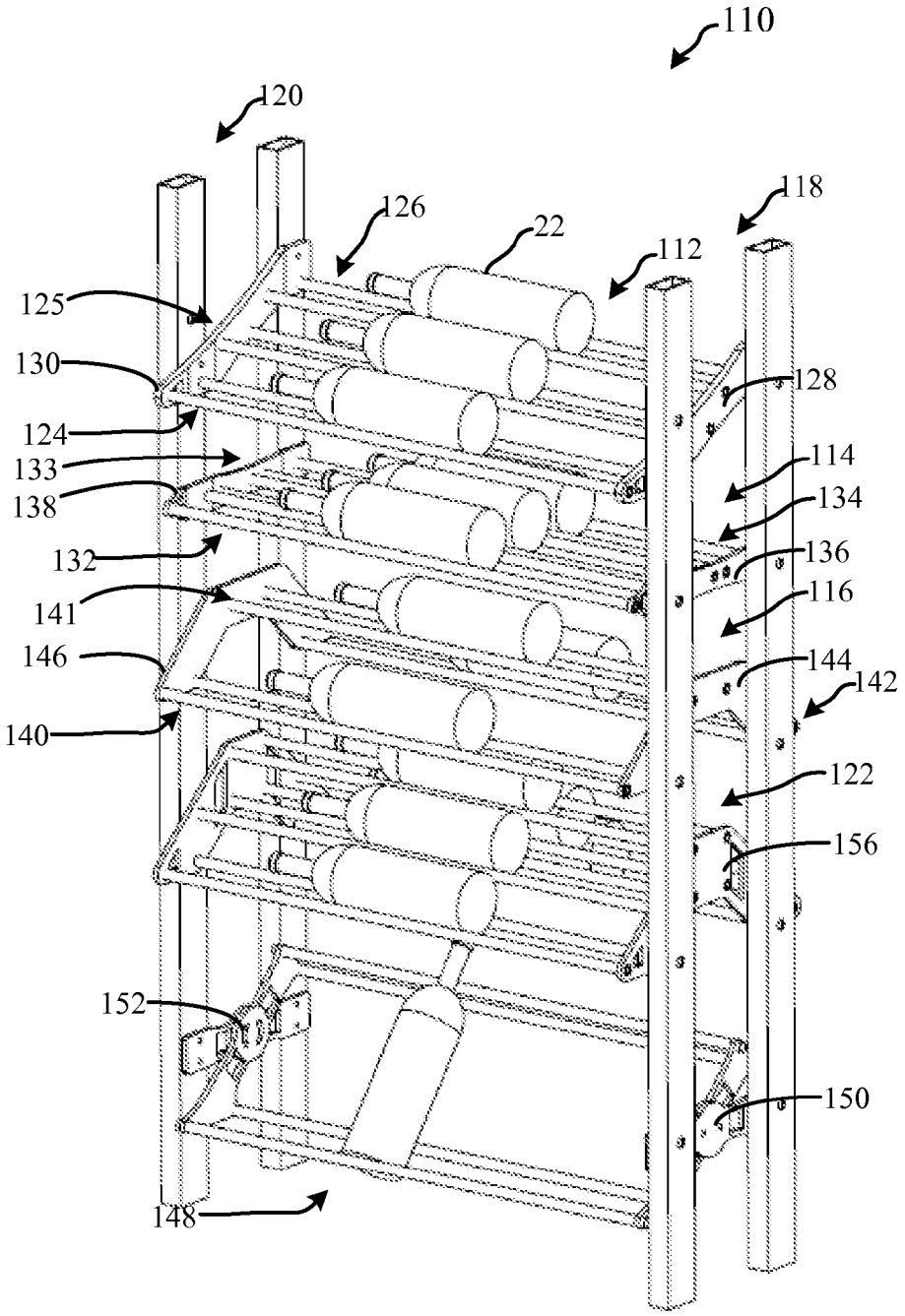
FIG. 4 shows a perspective view of a wine bottle storage system according to various embodiments.
Figure 5:
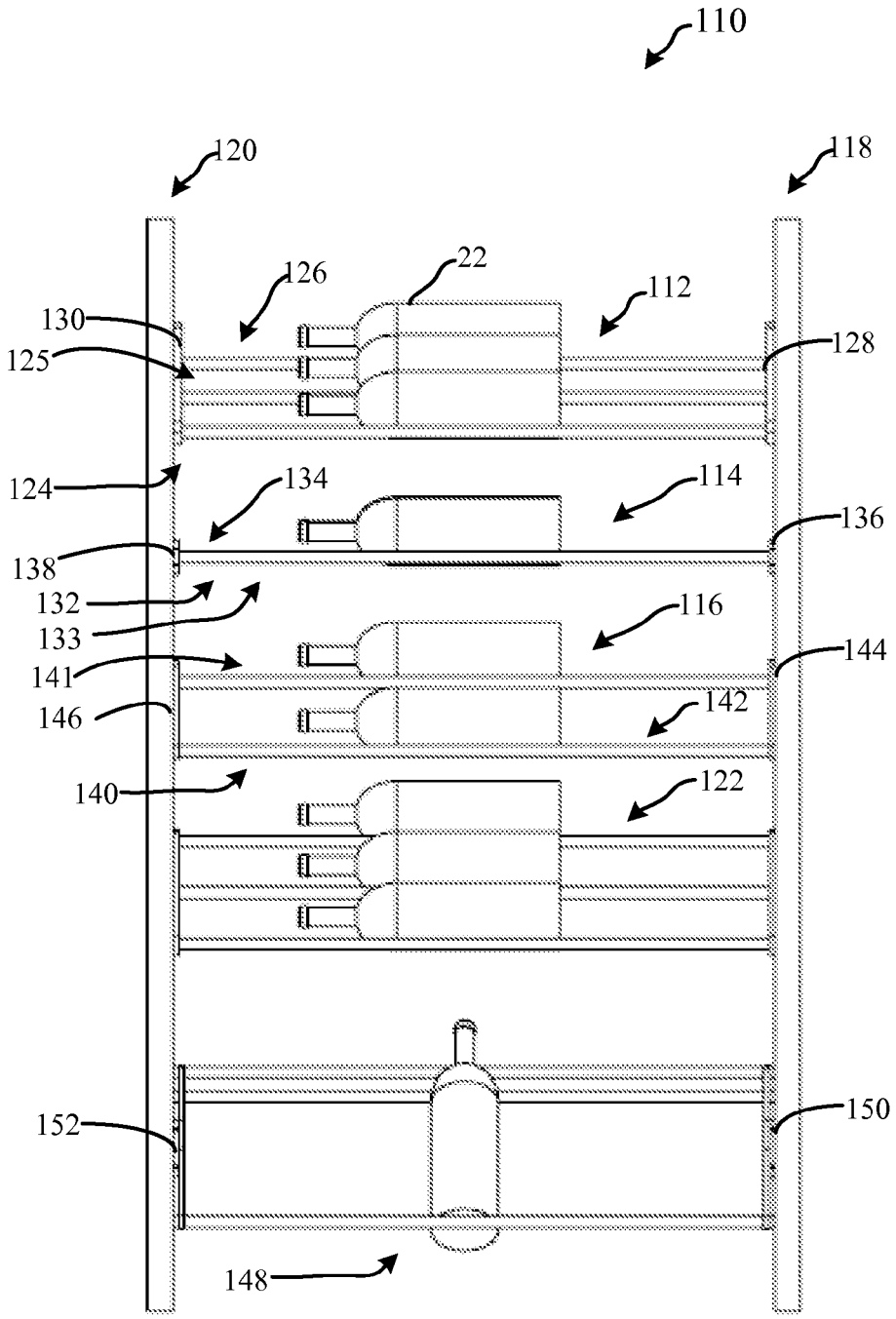
FIG. 5 shows a front view of a wine bottle storage system according to various embodiments.
Figure 6:
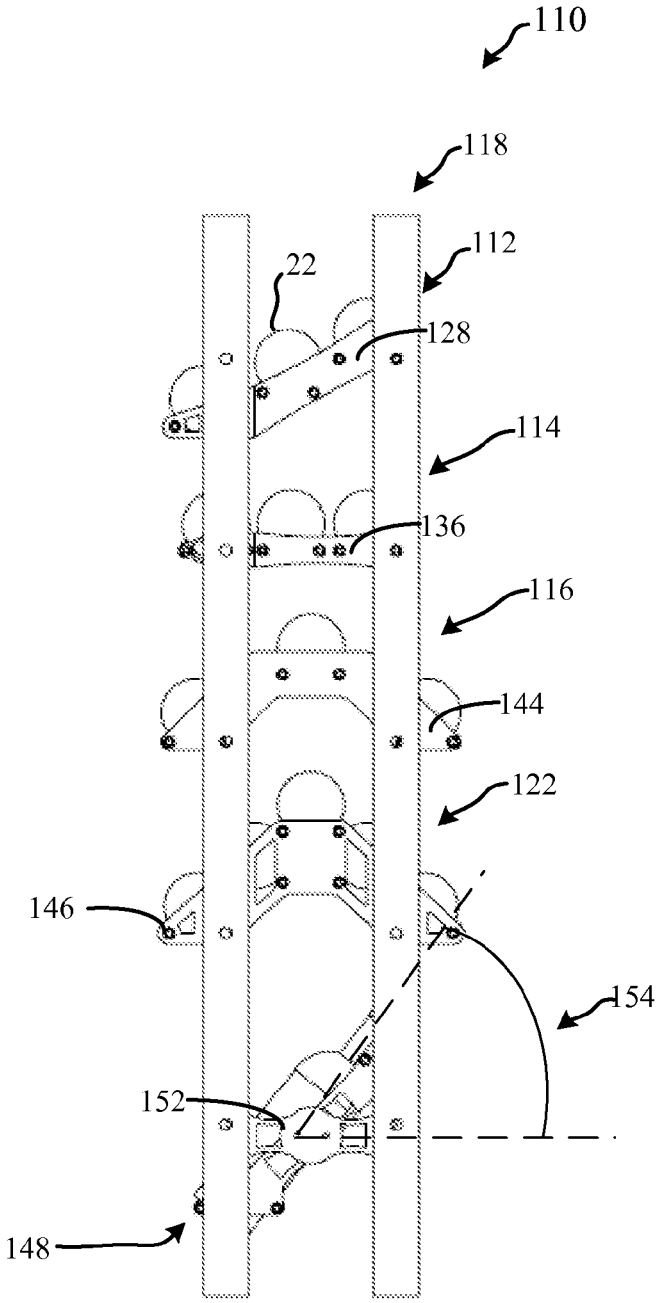
FIG. 6 shows a side view of wine bottle storage system according to various embodiments.

Turning now to FIG. 4, FIG. 5, and FIG. 6, which depict perspective, front, and side views, respectively, of a wine bottle storage system 110. The wine bottle storage system 110 may include aspects of the wine bottle storage system 10. In some embodiments, components described with reference to FIG. 1, 2, or 3 may be incorporated into the system 110 of FIGS. 4, 5, and 6; and components described with reference to FIG. 4, 5, or 6 may be incorporated into the system 10 of FIGS. 1, 2, and 3.

The wine bottle storage system 110 may include a first bottle shelf 112, a second bottle shelf 114 and a third bottle shelf 116. The bottle shelves 112, 114, and 116 may be connected to, and supported by first and second uprights 118 and 120. In some embodiments, each of uprights 118 and 120 are twin uprights. In some cases, the system 110 includes a fourth bottle shelf 122.

The bottle shelves 112, 114, 116, and 122 may each include a number of tubes that offer both structural support and serve to hold wine bottles 22. The first bottle shelf 112 may include a front tube pair 124, a middle tube pair 125, and a back tube pair 126. As with other shelf configurations, the first and second tube pairs 124, 126 may be configured parallel to one another. In some embodiments, each of the first and second tube pairs 124 and 126 are configured to hold one or more wine bottles 22 on the side of the wine bottle 22, such that multiple wine bottles 22 may be arranged end-to-end. In some embodiments, the bottle shelves 112, 114, 116, and 122 include additional tube pairs.

The first bottle shelf 112 may include ends 126 and 128. Each of the ends 126 and 128 may be brackets that are removably attachable to the uprights 118 and 120. The tube pairs 124, 125, and 126 may be attached or connected to the ends 128, 130 substantially as described above with reference to the system 10 and the first bottle shelf 12.

The bottle shelves 114, 116, and 122 may be configured similarly to the bottle shelf 112. For example, the second bottle shelf 114 may include a front tube pair 132, a middle tube pair 133, a back tube pair 134, a first end 136, and a second end 138. Each of these various components may be substantially the same as the components of the first bottles shelf 112, and they may be removably attached or connected to other components utilizing similar hardware as described above. Likewise, the third bottle shelf 116 may include a front tube pair 140, a middle tube pair 141, a back tube pair 142, a first end 144, and a second end 146. Each of the various components may be substantially the same as the components of the first bottle shelf 112, and they may be removably attached or connected to other components utilizing similar hardware as described above. Further, the fourth bottle shelf 122 may also be configured substantially as described above.

Each of the bottles shelves 112, 114, 116, and 122 may be configured to hold bottles in varying arrangements. For example, as best seen in FIG. 6, the bottles shelf 112 may be configured such that the wine bottles 22 are arranged in a cascade—e.g., the front tube pair 124 (FIG. 4) may be lower than the middle tube pair 125 (FIG. 4), and the middle tube pair 125 may be lower than the back tube pair 126 (FIG. 4). As describe here, a tube pair may be "lower than" another tube pair if that tube pair is configured to hold a wine bottle 22 at a height or elevation lower than another bottle. Thus, the bottle shelf 112 depicts an example in which the front tube pair 124 lower than the middle tube pair 125, which is lower than the back tube pair 126.

In some embodiments, the bottle shelf 114 is configured with a "flat" bottle arrangement, such that each of the tube pairs 132, 133, and 134 have a common elevation. But in some embodiments, the bottle shelves 116 and/or 122 are configured within "pyramid" bottle arrangements (FIG. 6). For example, the bottle shelf 116 may include a front tube pair 140 that is even with (e.g., has the same elevation as) the back tube pair 142, but is lower than the middle tube pair 141. In still other embodiments, a bottle shelf 122 may include an end bracket 156 and additional tube pairs such that a pyramid bottle configuration with more "steps" may be created. This distinction may best be seen in FIG. 6 by comparing bottle shelves 116 and 122.

In some cases, the bottle storage system 110 is equipped with a pivotable shelf 148, which includes pivotable ends 150, 152. The pivotable shelf 148 may include tube pairs substantially similar to the tube pairs described with reference to other shelves, e.g., bottles shelves 12, 14, 16, 112, 114, 116, and/or 122. The pivotable ends 150, 152 may be attached or connected to the uprights 118, 120 in a manner, and with hardware, as described above. And the pivotable ends 150, 152 may include brackets constructed such that the pivotable shelf 148 may pivot to create angle 154 (FIG. 6). The angle 154 may be an angle between zero and ninety degrees, such that the pivotable shelf may hold a wine bottle 22 nearly flat or nearly vertical. The pivotable shelf 148 may, for example, include stops and/or locks to allow the shelf 148 to be adjusted to any angle from zero to ninety degrees.

The wine bottle storage systems 10 and 110 may be modular and may be configured in a series. For example, the systems 10 and 110 may configured in a side-by-side arrangement where the upright 18 is disposed in a plane parallel to the upright 120, and the uprights 18 and 120 are attached or connected to one another. The uprights 18 and 120 may be connected utilizing hardware describe above. Thus, the systems 10 and 110, which may also be referred to as racks, may be stand-alone or linked together in a series. Those skilled in the art will recognize that a total storage capacity may be increased by adding racks (e.g., systems 10 and 110) adjacent to one another.

Additionally, those skilled in the art will recognize the describe systems may lend themselves to ease of assembly and disassembly. Because the racks are modular in nature, they may be shipped in a disassembled state and assembled at a different location.

Figure 7:
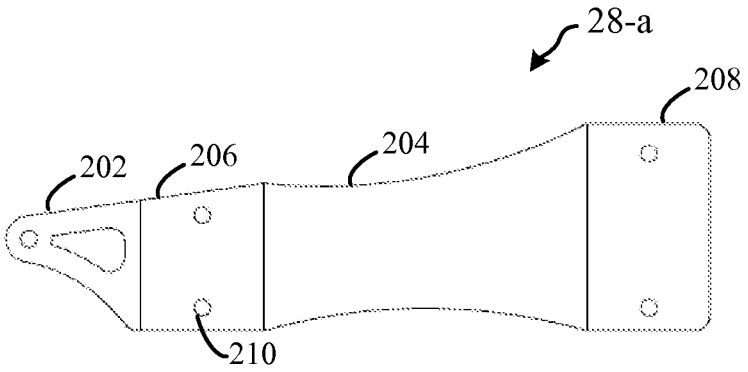
FIG. 7 shows a bracket for use in a wine bottle storage system according to various embodiments.

Next FIG. 7 depicts a bracket 28-*a*, which may an example of the end 28 described with reference to FIGS. 1, 2, and 3. The bracket 28-*a* may include a bottle tube mount 202, a body 204, upright attachment regions 206, 208, and a conductor pass-through 210. The upright attachment regions may be connected to the uprights 18, 20, 118, or 120 of system 10 and/or 110. The bottle tube mount 202 may support a tube pair or punt holder. The conductor pass-through may be used to support a light tube 58 and conductors that power LEDs of the light tube 58.

Figure 8:
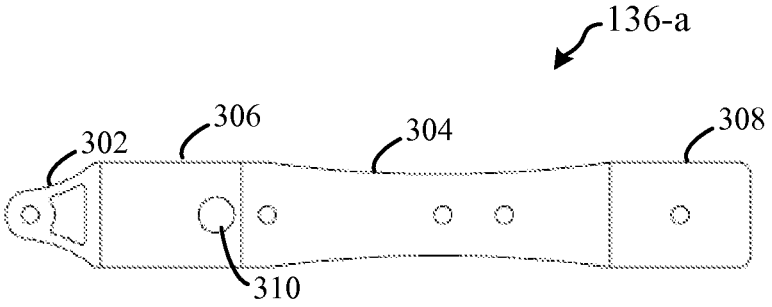
FIG. 8 shows a bracket for use in a wine bottle storage system according to various embodiments.

FIG. 8, depicts a bracket 136-*a*, which may an example of the end 136 described with reference to FIGS. 3, 4, and 5. The bracket 136-*a* may include a bottle tube mount 302, a body 304, upright attachment regions 306, 308, and a conductor pass-through 310. The upright attachment regions may be connected to the uprights 18, 20, 118, or 120 of system 10 and/or 110. The bottle tube mount 302 may support a tube pair or punt holder. The conductor pass-through may be used to support a light tube 58 and conductors that power LEDs of the light tube 58.

Figure 9:
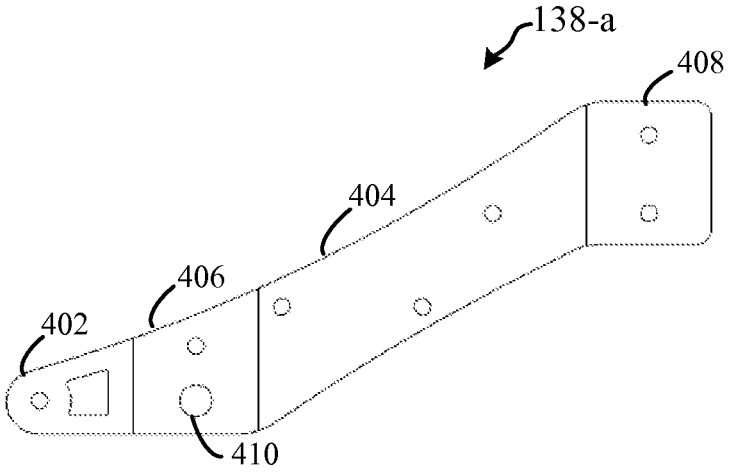
FIG. 9 shows a bracket for use in a wine bottle storage system according to various embodiments.

FIG. 9 depicts a bracket 138-*a*, which may an example of the end 138 described with reference to FIGS. 3, 4, and 5. The bracket 138-*a* may include a bottle tube mount 402, a body 404, upright attachment regions 406, 408, and a conductor pass-through 410. The upright attachment regions may be connected to the uprights 18, 20, 118, or 120 of system 10 and/or 110. The bottle tube mount 402 may support a tube pair or punt holder. The conductor pass-through may be used to support a light tube 58 and conductors that power LEDs of the light tube 58.

Figure 10:
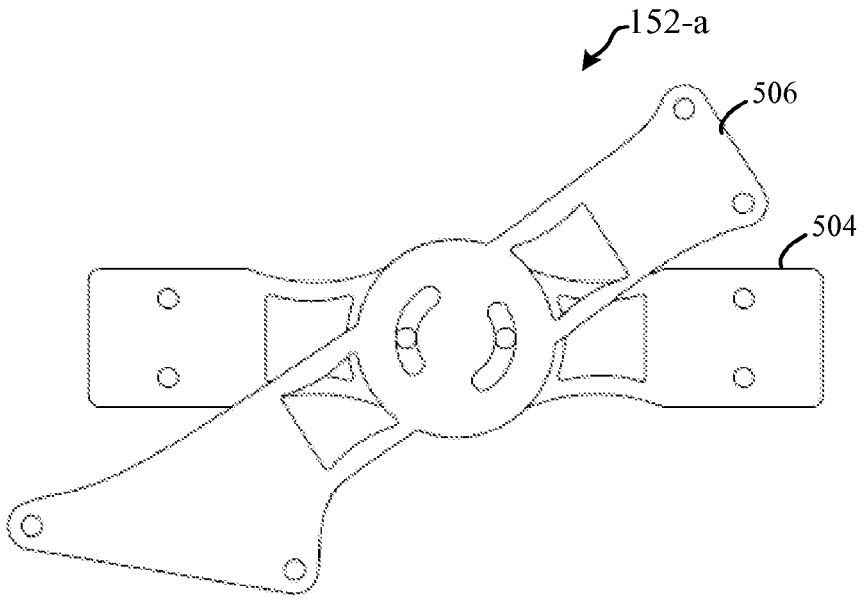
FIG. 10 shows a bracket for use in a wine bottle storage system according to various embodiments.

FIG. 10 depicts a bracket 152-*a*, which may be an example of the pivotable end 152 described with reference to FIGS. 3, 4, and 5. The bracket 152-*a* may include a body 504 and a bottle adjustment member 506. The bottle adjustment member 606 may be pivotably attached to the body 504, which may be connected to the uprights 18, 20, 118, or 120 of system 10 and/or 110.

Figure 11:
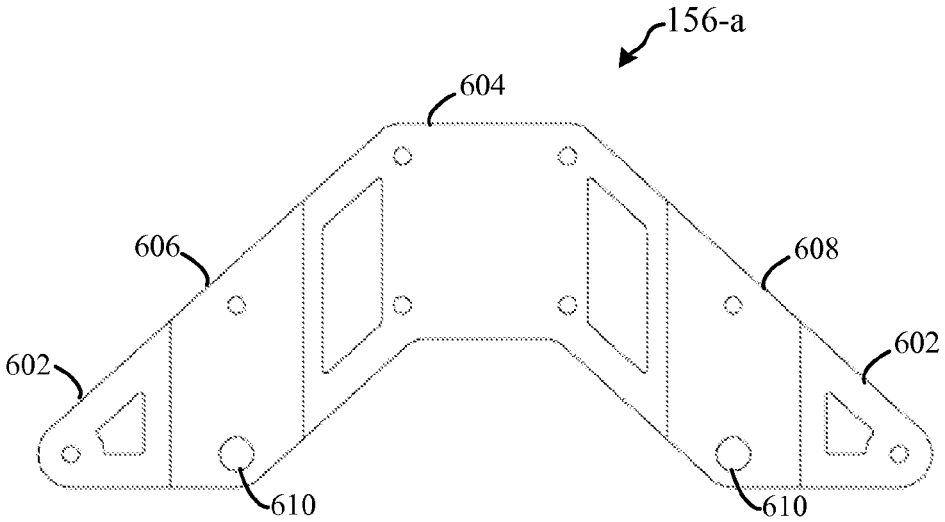
FIG. 11 shows a bracket for use in a wine bottle storage system according to various embodiments.

FIG. 11 depicts a bracket 156-*a*, which may an example of the end 156 described with reference to FIGS. 3, 4, and 5. The bracket 156-*a* may include bottle tube mounts 602, a body 604, upright attachment regions 606, 608, and conductor pass-throughs 610. The upright attachment regions may be connected to the uprights 18, 20, 118, or 120 of system 10 and/or 110. The bottle tube mounts 602 may support a tube pair. The conductor pass-throughs may be used to support a light tube 58 and conductors that power LEDs of the light tube 58.

The various components of the systems 10 and 110 described with reference to FIGS. 1, 2, 3, 4, 5, and 6, and brackets 28-*a*, 138-*a*, 136-*a*, 152-*a*, and 156-*a* described with reference to FIGS. 7, 8, 9, 10, and 11 may be constructed of, or fabricated from metal, including ferrous and non-ferrous metal. Additionally or alternatively, various components or aspects of the systems and brackets may be constructed of, or fabricated from plastic, wood, fiberglass, composite, or other similarly rigid material known in the art.

Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C).

The previous description of the disclosure is provided to enable a person skilled in the art to make or use the disclosure. Various modifications to the disclosure will be readily apparent to those skilled in the art, and the generic principles defined herein may be applied to other variations without departing from the spirit or scope of the disclosure. Throughout this disclosure the term "example" or "exemplary" indicates an example or instance and does not imply or require any preference for the noted example. Thus, the disclosure is not to be limited to the examples and designs described herein but is to be accorded the widest scope consistent with the principles and novel features disclosed herein.

What is claimed is:

1. A wine bottle storage system, comprising:

a first bottle shelf comprising a front tube pair, a back tube pair, a first end, and a second end, wherein one tube of the front tube pair of the first bottle shelf comprises a light tube comprising an internal light-emitting source, wherein the light tube is configured to support a punt end of a first wine bottle having a longitudinal axis normal to a longitudinal axis of the light tube, and wherein the light tube is rotatable about its longitudinal axis to illuminate a second wine bottle configured with a longitudinal axis normal to the longitudinal axis of the light tube;

a second bottle shelf comprising a front tube pair, a back tube pair, a first end, and a second end; and a first upright and a second upright, wherein the first and second uprights are disposed parallel to one another and in a plane normal to the first and second bottle shelves, and wherein the first end of the first bottle shelf and the first end of the second bottle shelf are connected to the first upright, and the second end of the first bottle shelf and the second end of the second bottle shelf are connected to the second upright.

2. The wine bottle storage system of claim 1, wherein:

the front tube pair of the first shelf comprises two tubes disposed parallel to one another and separated by a first distance, the back tube pair of the first shelf comprises two tubes disposed parallel to one another and separated by a second distance, the front tube pair and back tube pair of the first shelf are disposed parallel to one another and separated by a third distance, and wherein the third distance is greater than each of the first and second distance; and the front tube pair of the second shelf comprises two tubes disposed parallel to one another and separated by a fourth distance, the back tube pair of the second shelf comprises two tubes disposed parallel to one another and separated by a fifth distance, the front tube pair and back tube pair of the second shelf are disposed parallel to one another and separated by a sixth distance, and wherein the sixth distance is greater than each of the fourth and fifth distance.

3. The wine bottle storage system of claim 1, further comprising:

a third bottle shelf comprising a front tube pair, a back tube pair, a first end, and a second end, wherein the first end of the third bottle shelf is connected to the first upright, and the second end of the third bottle shelf is connected to the second upright, and wherein the third bottle shelf is disposed in a plane normal to the first and second uprights.

4. The wine bottle storage system of claim 1, wherein the front tube pair and the back tube pair of at least one of the first or second bottle shelves are configured with a planar offset of between five and thirty degrees.

5. The wine bottle storage system of claim 1, further comprising:

at least one neck rest having a first end and a second end, the at least one neck rest disposed in a plane parallel to the first and second bottle storage shelves and normal to the first and second uprights above at least one of the shelves, wherein the first end of the at least one neck rest is connected to the first upright and the second end of the at least one neck rest connected to the second upright.

6. The wine bottle storage system of claim 1, further comprising:

a third bottle shelf comprising a front tube pair, a back tube pair, a first end, and a second end;

a fourth bottle shelf comprising a front tube pair, a back tube pair, a first end, and a second end;

a third upright and a fourth upright, wherein the third and fourth uprights are disposed parallel to one another, parallel to the first and second uprights, and in a plane normal to the third and fourth bottle shelves, and wherein the first end of the third bottle shelf and the first end of the fourth bottle shelf are connected to the third upright, and the second end of the third bottle shelf and the second end of the fourth bottle shelf are connected to the fourth upright, and wherein the third upright is connected to the second upright.

7. The wine bottle storage system of claim 1, wherein the first and second uprights each comprise twin uprights.

8. The wine bottle storage system of claim 1, wherein the ends comprise brackets.

9. The system of claim 1, wherein the light tube is indexable and lockable at a connection to the first or second end of the first bottle shelf.

10. The system of claim 1, wherein the first or second end of the first bottle shelf comprises a conductor pass-through supporting the light tube.

11. A wine bottle storage system, comprising:

a first bottle storage shelf having first and second ends and a punt holder comprising a light tube with an internal light-emitting source, wherein the light tube is configured to support a punt end of a first wine bottle having a longitudinal axis normal to a longitudinal axis of the light tube, and wherein the light tube is rotatable about its longitudinal axis to illuminate a second wine bottle configured with a longitudinal axis normal to the longitudinal axis of the light tube;

a second bottle storage shelf having first and second ends and disposed in a plane parallel to the first bottle storage shelf; and a first upright and second upright;

wherein:

the first upright is disposed in a plane parallel to the second upright and normal to the first and second bottle storage shelves, the first ends of each of the first and second bottle storage shelves are connected to the first upright, and the second ends of each of the first and second bottle storage shelves are connected to the second upright.

12. The system of claim 11, wherein the light tube is indexable and lockable at a connection to the first or second end of the first bottle storage shelf.

13. The system of claim 11, wherein the first or second end of the first bottle storage shelf comprises a conductor pass-through supporting the light tube.

* * * * *